US010619859B2

(12) United States Patent
Zambruni

(10) Patent No.: US 10,619,859 B2
(45) Date of Patent: Apr. 14, 2020

(54) GAS COOKING DEVICE

(71) Applicant: SMEG S.p.A., Guastalla (IT)

(72) Inventor: Carlo Zambruni, Casalmaggiore (IT)

(73) Assignee: SMEG S.P.A. (IT)

( * ) Notice: Subject to any disclaimer, the term of this patent is extended or adjusted under 35 U.S.C. 154(b) by 380 days.

(21) Appl. No.: 15/423,682

(22) Filed: Feb. 3, 2017

(65) Prior Publication Data

US 2017/0227230 A1 Aug. 10, 2017

(30) Foreign Application Priority Data

Feb. 4, 2016 (IT) ..... 102016000011771

(51) Int. Cl.
*F24C 3/12* (2006.01)
*F24C 3/02* (2006.01)
*F24C 3/00* (2006.01)

(52) U.S. Cl.
CPC ..... *F24C 3/122* (2013.01); *F24C 3/008* (2013.01); *F24C 3/022* (2013.01); *F24C 3/126* (2013.01)

(58) Field of Classification Search
CPC ..... F24C 3/122; F24C 3/022; F24C 3/126; F24C 3/008; Y10T 137/87885; Y10T 137/5109; Y10T 137/5283; F23D 14/20; F23C 5/02
USPC ... 126/14, 25 R, 39 N, 39 R, 52, 85 R, 39 E, 126/39 H, 39 J, 39 K, 85; 431/52, 53, 55, 431/56, 82, 130, 221, 225; 285/124.1–124.5; 248/65–93
See application file for complete search history.

(56) References Cited

U.S. PATENT DOCUMENTS 2,782,779 A * 2/1957 Chambers ..... F24C 3/085 126/37 B
3,870,348 A 3/1975 Hawkins
2005/0257784 A1* 11/2005 Albizuri ..... F24C 3/12 126/39 N
2007/0044786 A1* 3/2007 Frost ..... F24C 3/126 126/39 N
2010/0264344 A1 10/2010 Shaffer et al.
2012/0145839 A1* 6/2012 Runels ..... F16L 3/18 248/74.4
2013/0019745 A1* 1/2013 Bagagli ..... F04B 39/1013 91/418

FOREIGN PATENT DOCUMENTS

| | | |
|---|---|---|
| CH | 308233 | 7/1955 |
| EP | 2341291 | 7/2011 |
| JP | S6017640 | 1/1985 |
| WO | 2015198173 | 12/2015 |

OTHER PUBLICATIONS

Corresponding Search Report for IT UB20160268 dated Sep. 6, 2016. IT.

* cited by examiner

*Primary Examiner* — Avinash A Savani
*Assistant Examiner* — Rabeeul I Zuberi
(74) *Attorney, Agent, or Firm* — The Belles Group, P.C.

(57) ABSTRACT

A gas cooking device is provided with: at least one burner; a gas supply conduit; at least one valve arranged between the gas supply conduit and the burner and configured to regulate the gas flow rate supplied to the burner; a fixing device configured to fix the valve to a first portion of the gas supply conduit; and a safety device configured to fix the valve to a second portion of the gas supply conduit.

16 Claims, 6 Drawing Sheets

GAS COOKING DEVICE

CROSS-REFERENCE TO RELATED APPLICATIONS

The present application claims priority under 35 U.S.C. § 119 to Italian Patent Application No. 102016000011771 filed on Feb. 4, 2016, the entirety of which is incorporated herein by reference.

FIELD OF THE INVENTION

The present invention concerns a gas cooking device. In particular, the present invention concerns a gas cooking device like a gas hob or a gas cooker.

BACKGROUND OF THE INVENTION

The gas cooking devices of known type generally comprise a gas supply conduit and a plurality of burners connected to the gas supply conduit by means of respective valves.

The valves can be controlled by the user by means of knobs and regulate the gas flow rate supplied to the respective burners.

Normally the valves are fixed to the supply conduit by means of a fixing device which in the majority of cases employs one or two screws.

This type of fixing device may not guarantee stable long-term fixing, particularly if one or more screws become loose or even break.

The risks connected with unstable fixing can be very high. Unstable fixing between valve and supply conduit can cause detachment of the valve from the supply conduit and lead to significant leakage of gas which can rapidly saturate the environment in which the gas cooking device is located.

Moreover, the risk of detachment is even higher in gas cooking devices—usually gas cookers—with control panel orthogonal to the surface on which the burners are arranged. In the devices of this type, in fact, the valves are arranged substantially horizontal below or above the gas supply conduit. If the valves are arranged below the gas supply conduit, detachment of the valves from the supply conduit is also favoured by the action of the gravitational force.

SUMMARY OF THE INVENTION

One object of the present invention is therefore to produce a gas cooking device which is reliable and free from the risks of the known art highlighted here; in particular, an object of the invention is to produce a gas cooking device which avoids the risks highlighted above in a simple inexpensive manner.

According to said objects, the present invention concerns a gas cooking device comprising:

- at least one burner;
- a gas supply conduit;
- at least one valve arranged between the gas supply conduit and the burner and configured to regulate the gas flow rate supplied to the burner;
- a fixing device configured to fix the valve to a first portion of the gas supply conduit;
- a safety device configured to fix the valve to a second portion of the gas supply conduit.

In this way, a malfunction of the fixing device does not cause detachment of the valve from the gas supply conduit.

The safety device, in fact, guarantees fixing between the valve and gas supply conduit even if the fixing device is malfunctioning.

BRIEF DESCRIPTION OF THE DRAWINGS

Further characteristics and advantages of the present invention will become clear from the following description of a non-limiting implementation example thereof with reference to the figures of the accompanying drawings, in which.

DETAILED DESCRIPTION OF THE INVENTION

Figure 1:
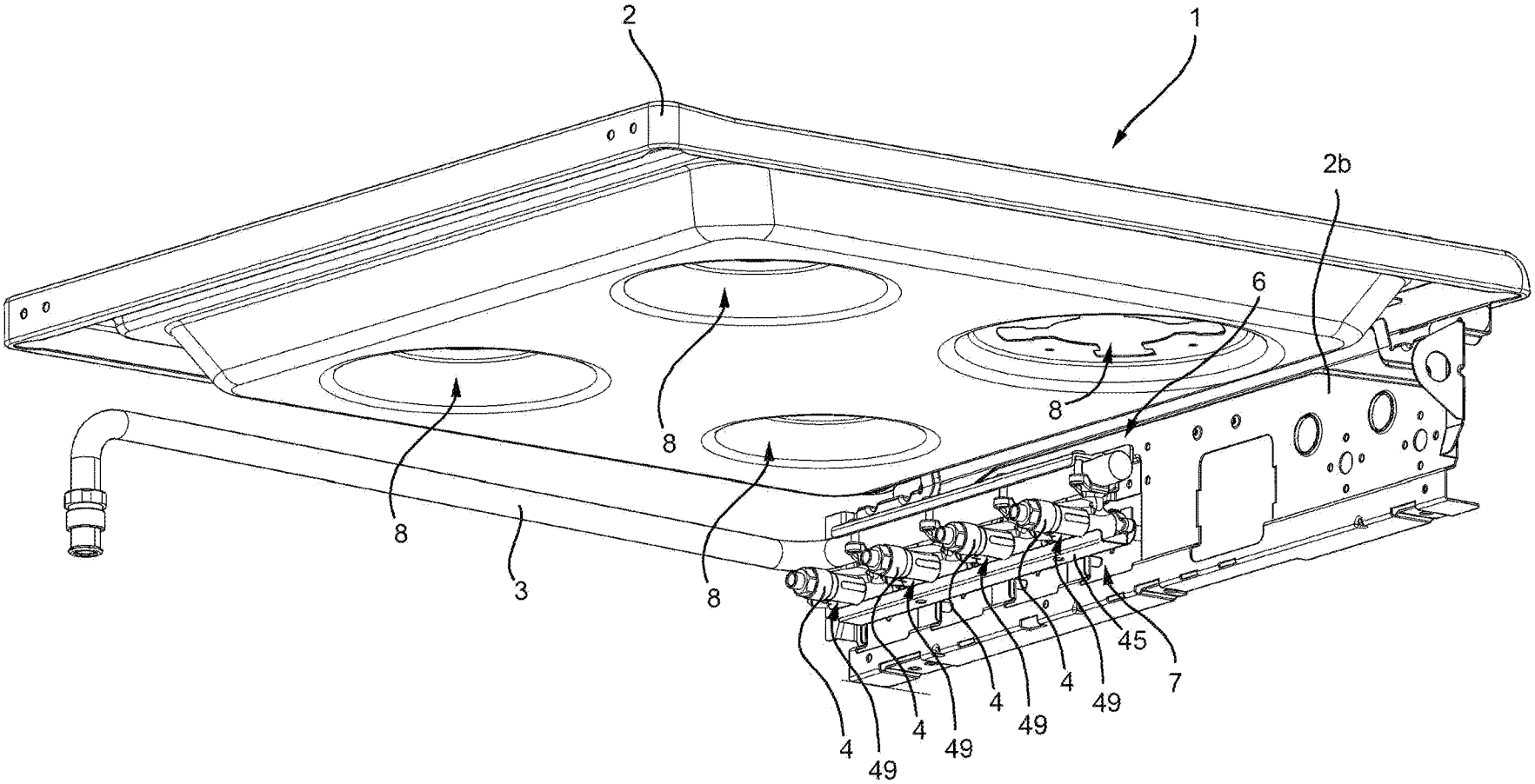
FIG. 1 is a perspective view, with parts removed for clarity, of a gas cooking device according to the present invention.

In FIG. 1 the reference number 1 indicates a gas cooking device.

The gas cooking device 1 comprises a work surface 2, at least one gas burner (not illustrated in the attached figures for the sake of simplicity) coupled with the work surface 2, a gas supply conduit 3 and at least one valve 4, which connects the gas supply conduit 3 to the burner and regulates the gas flow rate supplied to the burner.

The gas cooking device 1 further comprises a fixing device 6 and a safety device 7, configured, as will be seen in detail further on, to fix the valve 4 to the gas supply conduit 3 in a stable and secure manner.

In the non-limiting example described and illustrated here, the gas cooking device 1 comprises four burners and four respective valves 4.

The work surface 2 is substantially quadrangular and, in use, extends substantially along a horizontal plane. Along one of the sides, the work surface 2 is coupled with a front plate 2*b*, which is orthogonal to the work surface 2. The control knobs (not illustrated in the attached figures for the sake of simplicity) of the valves 4 are arranged along the front plate 2*b*, as will be seen in detail further on.

Each burner is fixed to the work surface 2 at respective openings 8 of the work surface 2 and is connected to the respective valve 4 by means of a hose (not illustrated in the attached figures for the sake of simplicity).

The gas supply conduit 3 is connected to a gas supply line (not illustrated in the attached figures for the sake of simplicity) and is provided with four openings 9 (visible in FIG. 2) which are substantially aligned, connected to the respective four valves 4.

Preferably, the gas supply conduit 3 extends just below the work surface 2 and mainly along a flat path which follows a portion of the perimeter of the work surface 2.

Figure 2:
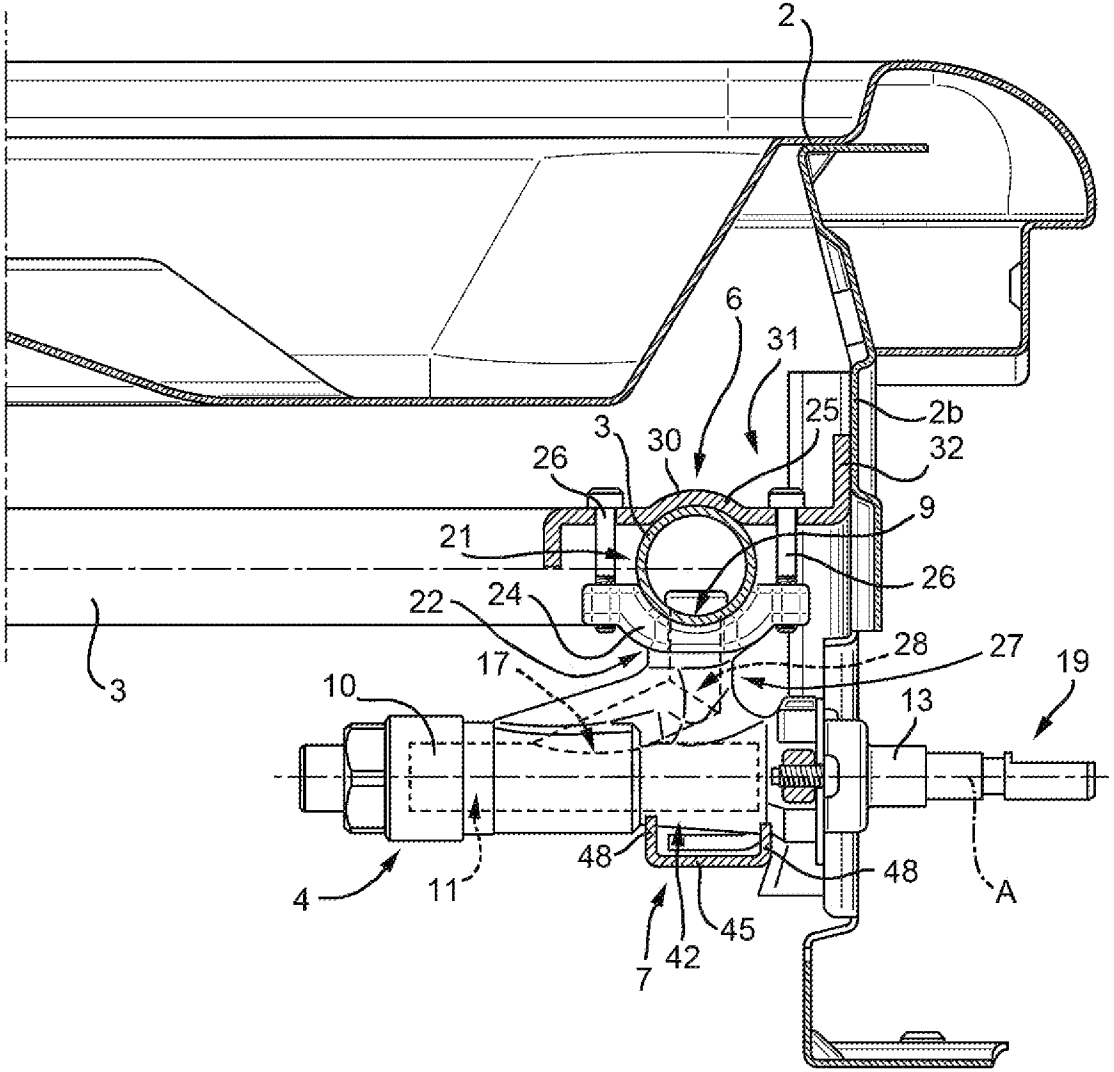
FIG. 2 is a section view, with parts removed for clarity, of a first detail of FIG. 1.

With reference to FIG. 2, each valve 4 comprises a main body 10, which is hollow so as to define an inner seat 11, a shutter (not visible in the attached figures) and an actuator 13 (partially visible in FIG. 2) configured to control the shutter. The shutter and the actuator 13 are mobile inside the seat 11 of the main body 10.

The main body 10 extends along a longitudinal axis A and is provided with a first opening 15 (visible only in FIGS. 3 and 4), communicating with the seat 11 and connected, in use, to the respective burner by means of the hose described previously, and a second opening 17 communicating with the seat 11 and coupled to the supply conduit 3 by means of the fixing device 6. In the non-limiting example described and illustrated here, the main body 10 is provided with a connection appendage 27 configured so as to define a connection channel 28 between the opening 17 of the valve and the opening 9 of the supply conduit 3.

In the non-limiting example described and illustrated here, the valves 4 are arranged with the axis A substantially horizontal in the use configuration.

The actuator 13 comprises a portion (not visible in the attached figures) which extends inside the seat 11 and is connected to the shutter and a portion 19 which extends outside the seat 11, which, in use, is coupled to a control knob (not illustrated in the attached figures for the sake of simplicity).

Via the knob, the user can adjust the angular position of the actuator 13, and consequently of the shutter.

The shutter (not visible in the attached figures) is configured so as to selectively regulate the gas flow rate which crosses the opening 17 according to the angular position of the actuator 13.

The fixing device 6 is configured so as to fix each valve 4 to a respective first portion 21 of the supply conduit 3.

In particular, the first portion 21 of the supply conduit 3 comprises the respective opening 9 for the passage of the gas.

Preferably, the fixing device 6 is configured to fix a first part 22 of the valve 4 to the first portion 21 of the supply conduit 3.

In the non-limiting example described and illustrated here, the fixing device 6 defines a vice-type fixing around the gas supply conduit 3 and comprises four first jaws 24 coupled to the respective valves 4 and four second jaws 25 bridging the supply conduit 3 at the openings 9.

The first jaws 24 are coupled to the respective second jaws 25 around the gas supply conduit 3 by means of fixing screws 26.

Preferably each first jaw 24 is made in one piece with the respective valve 4.

Figure 3:
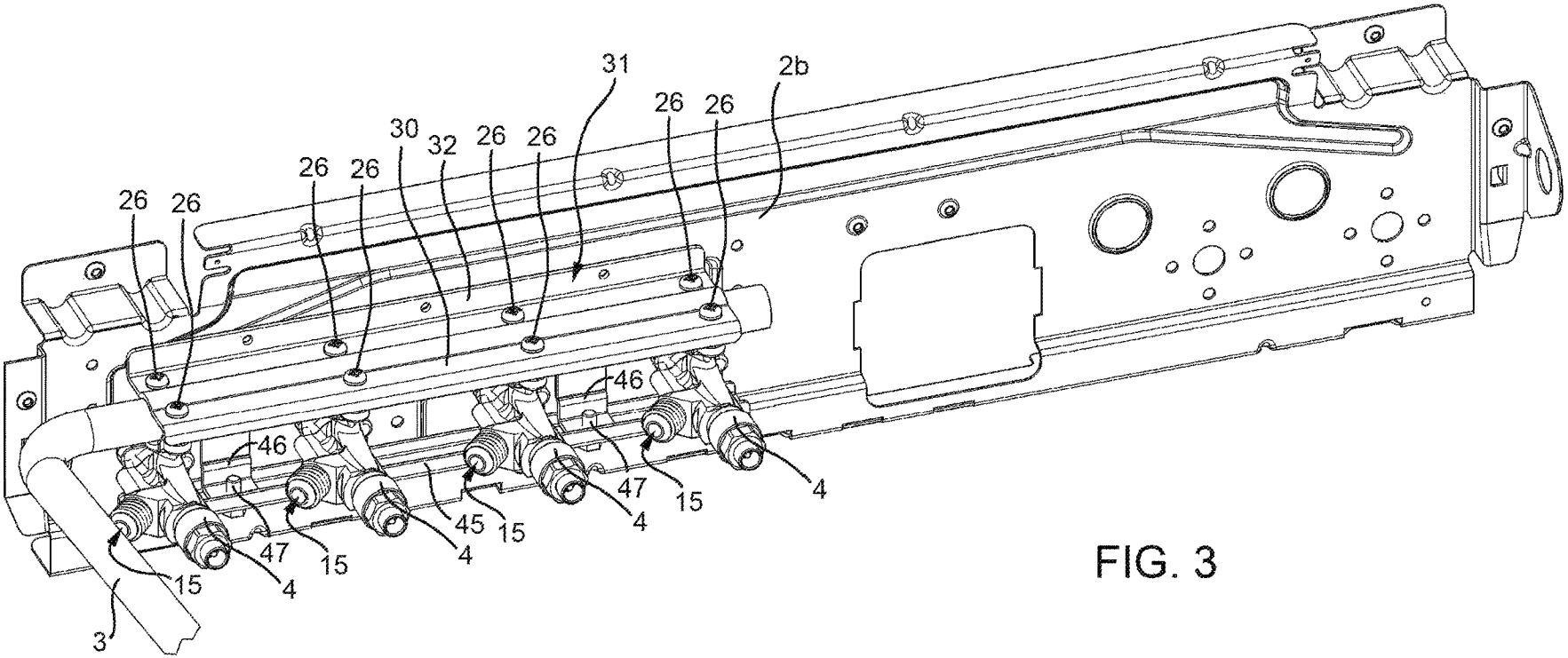
FIG. 3 is a perspective view, with parts removed for clarity, of the gas cooking device of FIG. 1.

Essentially, the first part 22 of the valve 4 comprises substantially the portion of the valve coupled to the jaw 24 of the fixing device 6. With reference to FIG. 2 and FIG. 3, the four second jaws 25 are preferably defined by one single wall 30 of a substantially L-shaped bracket 31.

The bracket 31 comprises a further wall 32 orthogonal to the first wall 30 and coupled to the front plate **2*b* by means of screws (not illustrated for the sake of simplicity in FIG. 3**).

Figure 4:
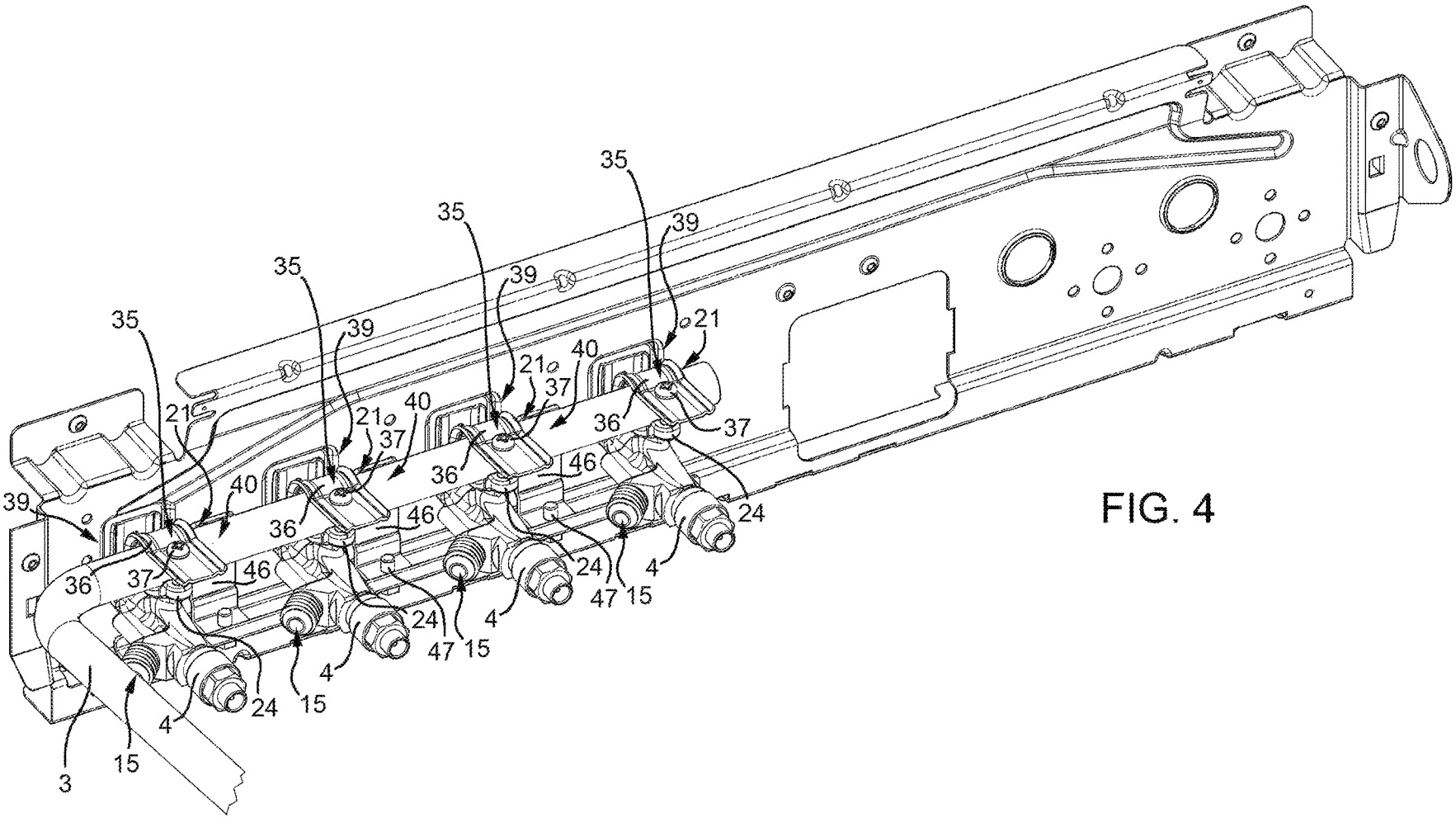
FIG. 4 is a perspective view, with parts removed for clarity, of a gas cooking device according to a first embodiment of the present invention.

According to a variation of the fixing device illustrated in FIG. 4, each second jaw 35 is defined by a metal tongue 36 which extends substantially around the supply conduit 3 at a first portion 21 and is fixed to the respective first jaw 24 by means of a screw 37. The tongue 36 is provided with a portion 39 bent in the shape of a U and adapted to be fixed to the front plate **2*b* by means of screws (not visible in FIG. 4**).

With reference to FIGS. 1-4, the safety device 7 is configured to fix the valve 4 to a second portion 40 (which can be seen better in FIG. 1 and FIG. 4) of the supply conduit 3 distinct from the first portion 21 to which the fixing device 6 is fixed.

In particular, the second portion 40 (which can be seen better in FIG. 4) of the supply conduit 3 is defined by the area between the openings 9 for the passage of the gas.

Preferably, the safety device 7 is configured to fix to the second portion 40 (which can be seen better in FIG. 4) of the supply conduit 3 a second part 42 (which can be seen better in FIG. 2) of the valve 4, distinct from the first part 22 of the valve 4.

In the non-limiting example described and illustrated here, the first part 22 and the second part 42 of the valve 4 are arranged on opposite sides with respect to the axis A. In the non-limiting example described and illustrated here, the safety device 7 comprises a support bracket 45 coupled to the second part 42 of each valve 4 and at least one support bar 46, which has a first end fixed to the support bracket 45 and a second end fixed to the second portion 40 of the supply conduit 3.

In the non-limiting example described and illustrated here, the safety device 7 comprises two support bars 46 each of which is fixed to a respective second portion 40 of the supply conduit 3.

Preferably, each support bar 46 is fixed to the support bracket 45 by means of screws 47 and is welded to the supply duct 3.

With reference to FIGS. 1 and 2, the support bracket 45 has a substantially U-shaped section and is provided with two parallel lateral walls 48 adapted to be coupled to the valves 4.

With reference to FIG. 1, the lateral walls 48 comprise an edge provided with depressions 49 adapted to house the second part 42 of the valves 4. In the non-limiting example described and illustrated here in which the valves 4 are arranged with the axis A horizontal, the valves 4 rest on the support bracket 45 at the respective depressions 49.

In other solutions, the fixing is by means of welding or other equivalent techniques.

Figure 5:
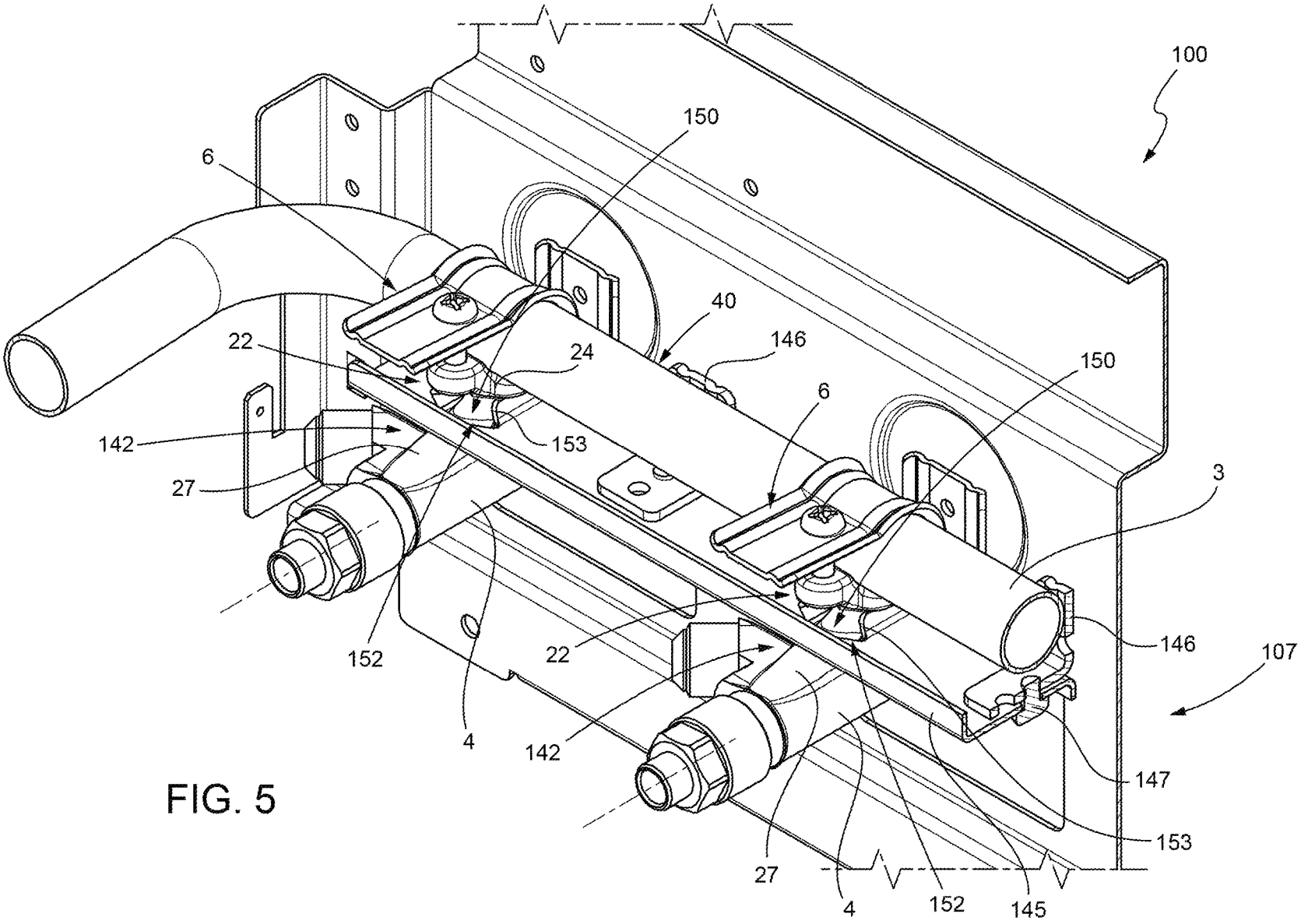
FIG. 5 is a perspective view, with parts removed for clarity and parts in section, of a gas cooking device according to a second embodiment of the present invention.
Figure 6:
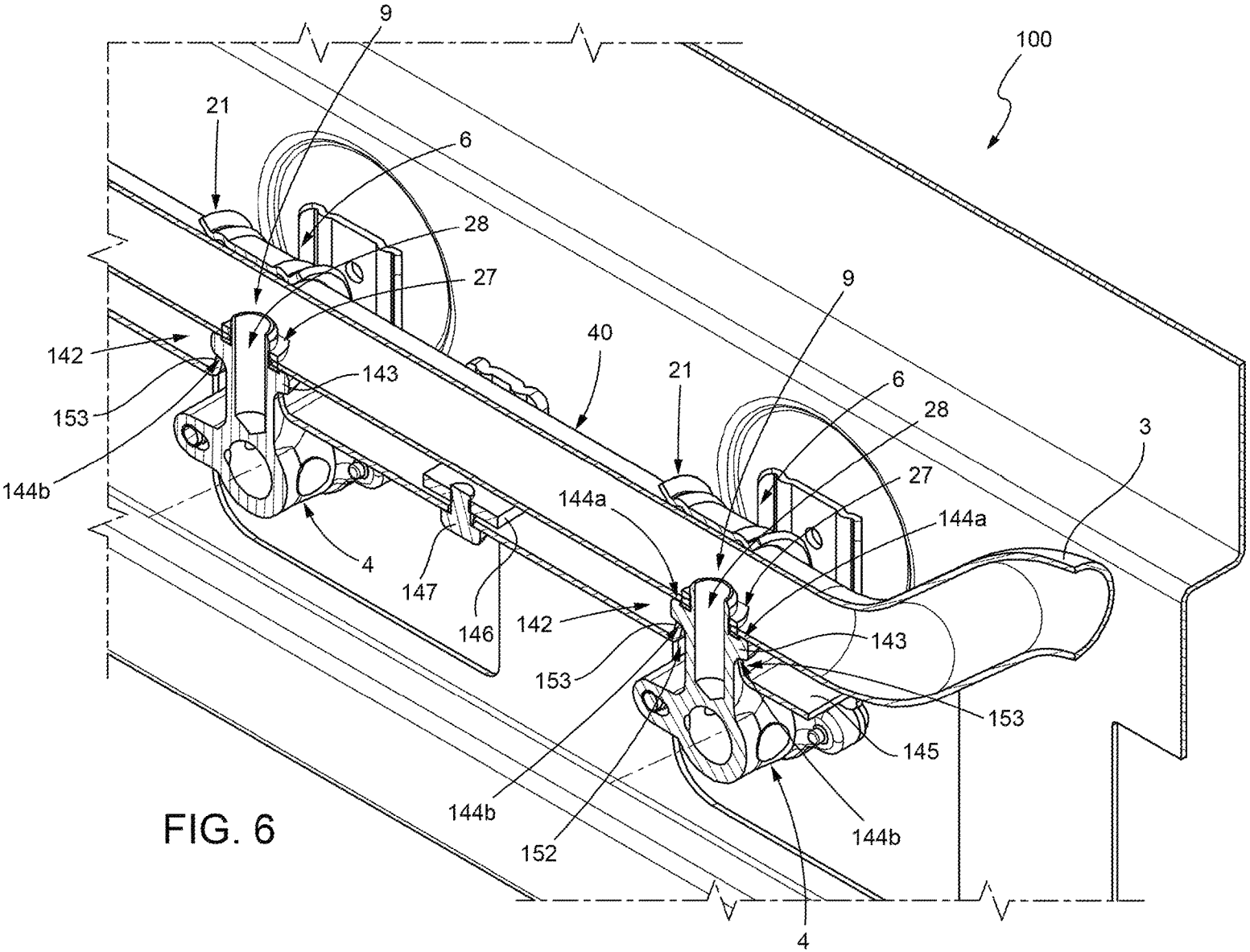
FIG. 6 is a perspective view in section, with parts removed for clarity, of a detail of the gas cooking device of FIG. 5.

FIGS. 5 and 6 illustrate a portion of a gas cooking device 100 according to a variation of the present invention.

The gas cooking device 100 differs from the gas cooking device 1 due to the fact that it comprises a safety device 107 different from the safety device 7. The same reference numbers will be maintained below as those used in the description of FIGS. 1-4 to indicate identical or similar parts.

The safety device 107 differs from the safety device 7 due to the fact that it comprises a support bracket 145 arranged between the supply conduit 3 and the valves 4.

The support bracket 145 is fixed, analogously to the support bracket 45, to at least one second portion 40 of the supply conduit 3 distinct from the first portion 21 to which the fixing device 6 is fixed.

As already mentioned previously and as better illustrated in FIG. 6, the second portion 40 of the supply conduit 3 is defined by the area between the openings 9 for the passage of the gas.

Preferably, the safety device 107 is configured to fix to the second portion 40 (seen better in FIG. 4) of the supply conduit 3 a second part 142 (only visible in FIG. 6) of the valve 4, distinct from the first part 22 (partially visible in FIG. 5 and seen better in FIG. 2) of the valve 4.

In the non-limiting example described and illustrated here, the first part 22 and the second part 142 of the valve 4 are arranged on the same side of the axis A.

In particular, the first part 22 comprises substantially the portion of the valve coupled to the jaw 24 of the fixing device 6, while the second part 142 comprises substantially an abutment ring 143 (visible only in FIG. 6) preferably arranged around the connection appendage 27 and the connection channel 28.

The abutment ring 143 projects from the connection appendage 27 so as to define a first abutment surface 144*a* and a second abutment surface 144*b* opposite the first abutment surface 144*a*.

Preferably, the abutment ring 143 is arranged in the vicinity of the opening 9 of the supply conduit 3. In this way, in use, the abutment ring 143 is arranged so that the abutment surface 144*a* is in contact with the outer surface of the supply conduit 3 and the abutment surface 144*b* abuts against the safety device 107.

The safety device 107 comprises, as already mentioned previously, a support bracket 145 coupled to the second part 142 of each valve 4 and at least one support bar 146 (easily seen in FIG. 5), which has a first end fixed to the support bracket 145 and a second end fixed to the second portion 40 of the supply conduit 3.

Preferably, each support bar 146 is fixed to the support bracket 145 by means of screws 147 and is welded to the supply conduit 3. Preferably each support bar 146 is L-shaped.

Obviously, since the support bracket 145 is arranged between the valves 4 and the supply conduit 3, the support bracket 145 is provided with openings 150 for the passage of respective portions of the valves 4. In the non-limiting example described and illustrated here, the openings 150 are configured so as to allow the passage of the connection appendages 27 of the valves 4.

Each opening 150 is provided with an edge 152, which has at least one portion bent so as to define a protrusion 153 designed to be arranged, in use, in abutment against the abutment surface 144*b*.

Obviously, the edge 152 is bent so that the protrusion 153 is on the face of the support bracket 145 facing, in use, towards the supply conduit 3.

In use, the safety device 107 fixes the valves 4 to the supply conduit 3 in a stable manner. The coupling between each valve 4 and the support bracket 145 and the coupling between the support bracket 145 and the supply conduit 3 guarantee the fixing between the valves 4 and the supply conduit 3 even in the case of malfunctioning of the fixing device 6. Advantageously, the safety device 7, 107 guarantees that the connection between the supply conduit 3 and the respective valves 4 is guaranteed even in the event of breakage or malfunctioning of the fixing device 6.

This prevents accidental leakage of gas between the supply conduit 3 and the valves 4 which can have serious consequences in terms of safety.

Lastly it is evident that modifications and variations can be made to the gas cooking device 1, 100 described here without departing from the scope of the attached claims.

What is claimed is:

1. A gas cooking device comprising:

at least one burner;

a gas supply conduit;

at least one valve arranged between the gas supply conduit and the burner and configured to regulate the gas flow rate supplied to the burner;

a fixing device configured to fix the valve to a first portion of the gas supply conduit;

a safety device configured to fix the valve to a second portion of the gas supply conduit so that the connection between the gas supply conduit and the valve is maintained even in the event of breakage or malfunctioning of the fixing device;

wherein the fixing device is coupled to a first part of the valve and the safety device is coupled to a second part of the valve, the first part of the valve being located closer to the gas supply conduit than the second part of the valve; and wherein the safety device comprises a support bracket coupled to the valve and a support bar, which has a first end fixed to the support bracket and a second end fixed to the second portion of the gas supply conduit.

2. A device according to claim 1, wherein the first portion and the second portion of the gas supply conduit are distinct.

3. A device according to claim 1, wherein the valve extends along a longitudinal axis, the first part and the second part of the valve being arranged on opposite sides of the longitudinal axis.

4. A device according to claim 1, wherein the valve extends along a longitudinal axis, the first part and the second part of the valve being arranged on the same side of the longitudinal axis.

5. A device according to claim 4, wherein the valve comprises an opening which can be connected to the gas supply conduit and a further opening which can be connected to the burner and a seat, the opening and the further opening being in communication with the seat.

6. A device according to claim 5, wherein the valve comprises a shutter housed in the seat and an actuator provided with a knob and configured to drive the shutter.

7. A device according to claim 1, wherein the fixing device comprises a first jaw coupled to the valve and a second jaw bridging the gas supply conduit.

8. A device according to claim 1, wherein the support bracket is provided with a housing or housing at least part of the valve.

9. A device according to claim 8, wherein the support bracket has a substantially U-shaped section and has two lateral parallel walls, each of which is provided with a depression for housing at least a part of the valve.

10. A device according to claim 1, wherein the valve extends along a longitudinal axis, which is arranged horizontal in the use configuration, and wherein the first portion of the gas supply conduit is aligned with the longitudinal axis of the valve and the second portion of the gas supply conduit is offset from the longitudinal axis of the valve.

11. A device according to claim 1, wherein a section of the gas supply conduit to which the valve is coupled extends along a longitudinal axis, and wherein the first and second portions of the gas supply conduit are at different axial positions along the gas supply conduit.

12. A device according to claim 1, wherein the gas supply conduit comprises at least one opening, and wherein the first portion of the gas supply conduit comprises the opening and the fixing device is aligned with the opening.

13. A device according to claim 12 wherein the second portion of the gas supply conduit does not comprise the opening.

14. A device according to claim 1, further comprising:

a plurality of the burners;

a plurality of the valves, each of the valves coupled to one of the burners;

the gas supply conduit comprising a plurality of openings;

a plurality of the fixing devices, each of the fixing devices configured to fix one of the valves to one of a plurality of the first portions of the gas supply conduit, each of the first portions of the gas supply conduit comprising one of the openings; and a plurality of the safety devices, each of the safety devices configured to fix one of the valves to one of a plurality of the second portions of the gas supply conduit, each of the second portions of the gas supply conduit located between two adjacent ones of the openings.

15. A gas cooking device comprising:

at least one burner;

a gas supply conduit extending along a first longitudinal axis;

at least one valve operably coupled to the gas supply conduit and the burner to regulate the gas flow rate supplied to the burner, the at least one valve extending along a second longitudinal axis;

a fixing device configured to fix a first portion of the valve located on a first side of the second longitudinal axis to a first portion of the gas supply conduit located at a first axial position along the first longitudinal axis; and a safety device configured to fix a second portion of the valve located on a second side of the second longitudinal axis to a second portion of the gas supply conduit located at a second axial position along the first longitudinal axis; and wherein the fixing device is configured to provide a vice coupling around the gas supply conduit.

16. A gas cooking device comprising:

at least one burner;

a gas supply conduit comprising an opening;

at least one valve operably coupled to the opening of the gas supply conduit and to the burner to regulate the gas flow rate supplied to the burner, the at least one valve extending along a longitudinal axis;

a fixing device configured to fix the valve to a first portion of the gas supply conduit that comprises the opening, the fixing device comprising a first jaw coupled to a first portion of the valve and a second jaw bridging the gas supply conduit at the opening, the first and second jaws being coupled to one another around the gas supply conduit by one or more fixing screws;

a safety device configured to fix the valve to a second portion of the gas supply conduit that is distinct from the first portion of the gas supply conduit, the safety device comprising a support bracket coupled to a second portion of the valve and a support bar having a first end fixed to the support bracket and a second end welded to the second portion of the gas supply conduit; and wherein the first and second jaws of the fixing device are aligned with the longitudinal axis of the valve and the support bar of the safety device is offest from the longitudinal axis of the valve.

* * * * *